US007311227B2

(12) United States Patent
Foster

(10) Patent No.: US 7,311,227 B2
(45) Date of Patent: Dec. 25, 2007

(54) TRIGGER SPRAYER VENTING SYSTEM WITH REDUCED DRAG ON VENT PISTON

(75) Inventor: Donald D. Foster, St. Charles, MO (US)

(73) Assignee: Continental AFA Dispensing Company, St. Peters, MO (US)

( * ) Notice: Subject to any disclaimer, the term of this patent is extended or adjusted under 35 U.S.C. 154(b) by 344 days.

(21) Appl. No.: 11/176,050

(22) Filed: Jul. 7, 2005

(65) Prior Publication Data

US 2006/0086763 A1 Apr. 27, 2006

Related U.S. Application Data

(63) Continuation-in-part of application No. 10/961,286, filed on Oct. 8, 2004.

(51) Int. Cl.
*B67D 5/42* (2006.01)

(52) U.S. Cl. ..... 222/383.1; 222/481.5; 239/333

(58) Field of Classification Search ..... 222/321.7, 222/321.9, 383.1, 481.5; 239/333
See application file for complete search history.

(56) References Cited

U.S. PATENT DOCUMENTS 4,072,252 A 2/1978 Steyns et al.
4,230,277 A 10/1980 Tada
4,350,298 A 9/1982 Tada
4,815,663 A 3/1989 Tada
4,819,835 A 4/1989 Tasaki
4,958,754 A 9/1990 Dennis
5,337,928 A 8/1994 Foster et al.
5,715,974 A 2/1998 Foster et al.
5,938,082 A * 8/1999 Foster et al. ..... 222/153.09
5,996,847 A 12/1999 Smolen et al.
6,550,694 B1 * 4/2003 Foster et al. ..... 239/304
6,641,003 B1 * 11/2003 Foster et al. ..... 222/383.1
2006/0086762 A1 4/2006 Foster et al.
2006/0086763 A1 4/2006 Foster

* cited by examiner

*Primary Examiner*—Joseph A. Kaufman
(74) *Attorney, Agent, or Firm*—Thompson Coburn LLP

(57) ABSTRACT

A venting system of a manually operated trigger sprayer vents the interior of a liquid container connected to the trigger sprayer. The trigger sprayer is provided with a vent chamber that surrounds the pump chamber, and a vent piston that surrounds the pump piston. The vent piston is received in the vent chamber for reciprocating movements between a vent closed and vent opened position in the vent chamber, and the vent chamber having two different interior diameter sections with a larger interior diameter section reducing drag on the vent piston when the vent piston is moved to the vent opened position.

19 Claims, 2 Drawing Sheets

TRIGGER SPRAYER VENTING SYSTEM WITH REDUCED DRAG ON VENT PISTON

This patent application is a continuation-in-part of patent application Ser. No. 10/961,286, which was filed on Oct. 8, 2004, and is currently pending.

BACKGROUND OF THE INVENTION (1) Field of the Invention

The present invention pertains to a venting system for a manually operated, liquid dispensing trigger sprayer. More specifically, the present invention pertains to improvements to a venting system of a manually operated trigger sprayer that vents the interior of a liquid container connected to the trigger sprayer. For the most part, the construction of the trigger sprayer is typical. The improvement comprises a vent chamber that surrounds the pump chamber and a vent piston that surrounds the pump piston. The vent piston is received in the vent chamber for reciprocating movements with the pump piston in the pump chamber. The reciprocating movement of the vent piston alternatively opens the vent chamber to the exterior environment of the trigger sprayer and thereby vents the interior of the liquid container connected to the trigger sprayer, and closes the vent chamber thereby sealing the interior of the liquid container from the exterior environment. The interior of the vent chamber has a novel configuration where the interior diameter of the vent chamber gets larger as the vent chamber extends from a forward portion of the vent chamber toward a rearward portion of the vent chamber. This reduces the drag or friction between the peripheral sealing edge of the vent piston and the interior surface of the vent chamber as the vent piston moves from the forward portion of the vent chamber toward the rearward portion of the vent chamber.

(2) Description of the Related Art

A typical manually operated liquid dispensing trigger sprayer comprises a sprayer housing that has a nozzle for dispensing liquid, a trigger mounted on the sprayer housing for movement of the trigger relevant to the housing, a pump chamber on the housing, and a pump piston operatively connected to the trigger and received in the pump chamber for reciprocating movement of the piston in the pump chamber in response to manual movement of the trigger, and a connector attaching the trigger sprayer to a liquid container. The reciprocating movement of the pump piston in the pump chamber alternately draws liquid from the liquid container into the pump chamber, and then pumps the liquid out of the pump chamber and dispenses the liquid through the nozzle of the sprayer housing as a spray or stream.

Trigger sprayers of this type are often provided with some system of venting the interior of the liquid container connected to the trigger sprayer. This allows air to enter the container interior and occupy that portion of the internal volume of the container that is vacated by the liquid dispensed from the container by the trigger sprayer.

Many different types of trigger sprayer venting systems have been developed in the prior art. One type of venting system employs a resilient diaphragm valve that is positioned in the interior of the sprayer housing covering over a vent hole in the sprayer housing. The vent hole communicates the interior of the sprayer housing and the interior of the connected liquid container with the exterior environment of the sprayer. A plunger is provided on the trigger member of the trigger sprayer. The plunger projects from the bottom of the pump piston rod and curves toward the sprayer housing with a distal end of the plunger being positioned just outside of the vent hole. On manual manipulation of the trigger, the plunger end is inserted through the vent hole and engages the diaphragm valve, displacing the diaphragm valve from its position over the vent hole. This vents the interior of the liquid container. On the return movement of the trigger the plunger is retracted out of the vent hole and the resilience of the diaphragm valve allows it to resume its position over the vent hole.

However, this prior art venting system has been found to be disadvantaged in that repeated use of the trigger sprayer causes repeated displacement of the diaphragm valve from the sprayer vent hole. The resiliency of the diaphragm valve is effected by these repeated displacements and the valve is no longer able to immediately reposition itself over the vent hole once the plunger is retracted from the vent hole. This can result in liquid leaking from the container through the vent hole should the container and trigger sprayer be knocked over on one side before the diaphragm valve repositions itself over the vent hole. In addition, the plunger projecting from the piston rod is considered by many to detract from the appearance of the sprayer and is undesirable.

Another type of venting system employs a vent cylinder on the sprayer housing and a vent piston operatively connected to the trigger of the trigger sprayer. The vent piston, like the previously described plunger, projects from the pump piston rod. The vent hole is positioned in the side of the vent cylinder and one or more small ribs are formed on the interior surface of the vent cylinder in the area of the vent hole. The vent piston curves beneath the pump piston rod and extends into the vent cylinder where the vent piston engages in a sliding, sealing engagement with the interior surface of the vent cylinder. As the trigger is manipulated, the vent piston is pushed through the vent cylinder toward the vent hole and the ribs. The ribs engage with the periphery of the vent piston and displace the periphery from the interior surface of the vent cylinder, thereby communicating the exterior environment of the trigger sprayer around the piston and through the vent cylinder and the vent hole to the interior of the liquid container.

This venting system has been found to be disadvantaged in that is has the same unappealing appearance of the plunger. Also, after repeated use of the trigger sprayer, the ribs in the vent cylinder have a tendency to deform the resilient material around the periphery of the vent piston. This detracts from the ability of the vent piston to seal against the interior surface of the vent cylinder, and can result in leakage of liquid from the liquid container through the vent cylinder.

Trigger sprayer designs have eliminated the projecting plunger or vent piston rod that detracts from the overall appearance of the trigger sprayer. These designs employ a vent piston that is coaxial with the pump piston of the trigger sprayer, and is moved by the pump piston rod of the trigger sprayer. The vent piston is moved through a vent chamber that is coaxial with the trigger sprayer pump chamber. This double piston design is more desirable because it eliminates the separate plunger arm or vent piston arm from the pump piston rod.

However, the sliding engagement or rubbing of the vent piston peripheral sealing surface across the cylindrical interior surface of the vent chamber as the trigger sprayer pump is operated often causes swelling of the material of the vent piston. This swelling of the vent piston can bind the vent piston in the vent chamber, making it difficult or uncomfortable to push the vent piston into the vent chamber, and at times preventing the vent piston from being pushed back out of the vent chamber by the pump spring. What is needed to overcome this disadvantage of trigger sprayers having coaxial pump and vent chambers is a redesign of the venting system that eliminates the cause of vent piston swelling, and thereby prevents binding of the vent piston in the vent chamber.

SUMMARY OF THE INVENTION

The present invention overcomes disadvantages associated with prior art venting systems of trigger sprayers by providing an improved trigger sprayer venting system that vents air to the liquid container connected to the trigger sprayer and prevents liquid from leaking through the venting system should the trigger sprayer and liquid container be turned on one side, where the venting system eliminates the undesirable appearance of the vent plunger or vent piston employed in the prior art, and the venting system eliminates the problem of the vent piston sticking in the vent chamber by eliminating swelling of the vent piston and the vent chamber wall.

Much of the construction of the trigger sprayer of the invention is common to trigger sprayers. The trigger sprayer is generally constructed with a sprayer housing that is connected by a separate connector to a fluid container. The sprayer housing is formed with a liquid pump chamber that communicates with a liquid supply passage and a liquid discharge passage. A pump piston is mounted in the pump chamber for reciprocating movement. A trigger is mounted on the sprayer housing for manual manipulation. The trigger is operatively connected with the pump piston, and manipulation of the trigger reciprocates the pump piston in the pump chamber. Reciprocation of the pump piston alternatively draws liquid from the liquid container, through the liquid supply passage, and to the pump chamber, and then pumps the liquid from the pump chamber, through the liquid discharge passage, and dispenses the liquid from the sprayer housing as a spray or stream.

The trigger sprayer of the invention differs in construction from that of prior art trigger sprayers in the venting system provided on the trigger sprayer. The venting system is basically comprised of a vent chamber, and a vent piston received inside the vent chamber for reciprocating movement of the vent piston relative to the vent chamber.

The vent chamber is formed on the sprayer housing around the pump chamber of the trigger sprayer. The vent chamber has a cylindrical side wall that extends around and surrounds the pump chamber. This coaxial positioning of the pump chamber and vent chamber relative to each other eliminates the undesirable appearance of the vent plunger or vent piston rod of the trigger sprayer. A vent hole is provided in the sidewall of the vent chamber. The vent hole communicates the interior volume of the vent chamber with the interior of the liquid container connected to the trigger sprayer.

The vent chamber sidewall has a cylindrical interior surface that extends from an open, forward end of the vent chamber to a closed, rearward end of the vent chamber. The interior surface has a larger interior diameter dimension adjacent the rearward end of the vent chamber. The interior diameter dimension remains consistent for a majority of the length of the vent chamber as the vent chamber extends from the rearward end toward the forward, open end of the vent chamber. As the vent chamber approaches the forward end of the vent chamber, the interior diameter dimension of the vent chamber interior surface gradually decreases, forming a necked down interior surface of the vent chamber having a smaller interior diameter dimension adjacent the chamber forward end.

With the vent chamber being coaxial with the pump chamber, the vent piston is formed coaxially around the pump piston. The vent piston is formed of the same resilient material as the pump piston. In a first position of the vent piston relative to the vent chamber, the peripheral surface of the vent piston engages in a sealing engagement with the necked down portion of the vent chamber interior surface at the vent chamber forward end. This seals the interior of the vent chamber from the exterior environment of the trigger sprayer, and prevents unintended liquid leakage from the liquid container attached to the trigger sprayer through the vent chamber.

On actuation of the liquid pump, the vent piston moves with the pump piston. The vent piston moves away from the necked down portion of the vent chamber interior surface having the smaller interior diameter, toward the rearward end of the vent chamber. This movement of the vent piston causes the force of engagement of the peripheral surface of the vent piston against the interior surface of the vent chamber to decrease, thereby reducing the drag on the vent piston peripheral surface as the vent piston moves from the vent chamber forward end toward the vent chamber rearward end and through the larger interior diameter portion of the vent chamber. This reduced drag prevents swelling of the peripheral surface of the vent piston and/or the vent chamber interior surface, and prevents binding of the vent piston in the vent chamber.

With the novel construction of the venting system of the invention described above, the trigger sprayer of the invention overcomes disadvantages commonly associated with prior art trigger sprayer venting systems.

BRIEF DESCRIPTION OF THE DRAWINGS

Further features of the present invention are set forth in the following detailed description of the preferred embodiment of the invention and in the drawing figures wherein.

DETAILED DESCRIPTION OF THE PREFERRED EMBODIMENT

Figure 1:
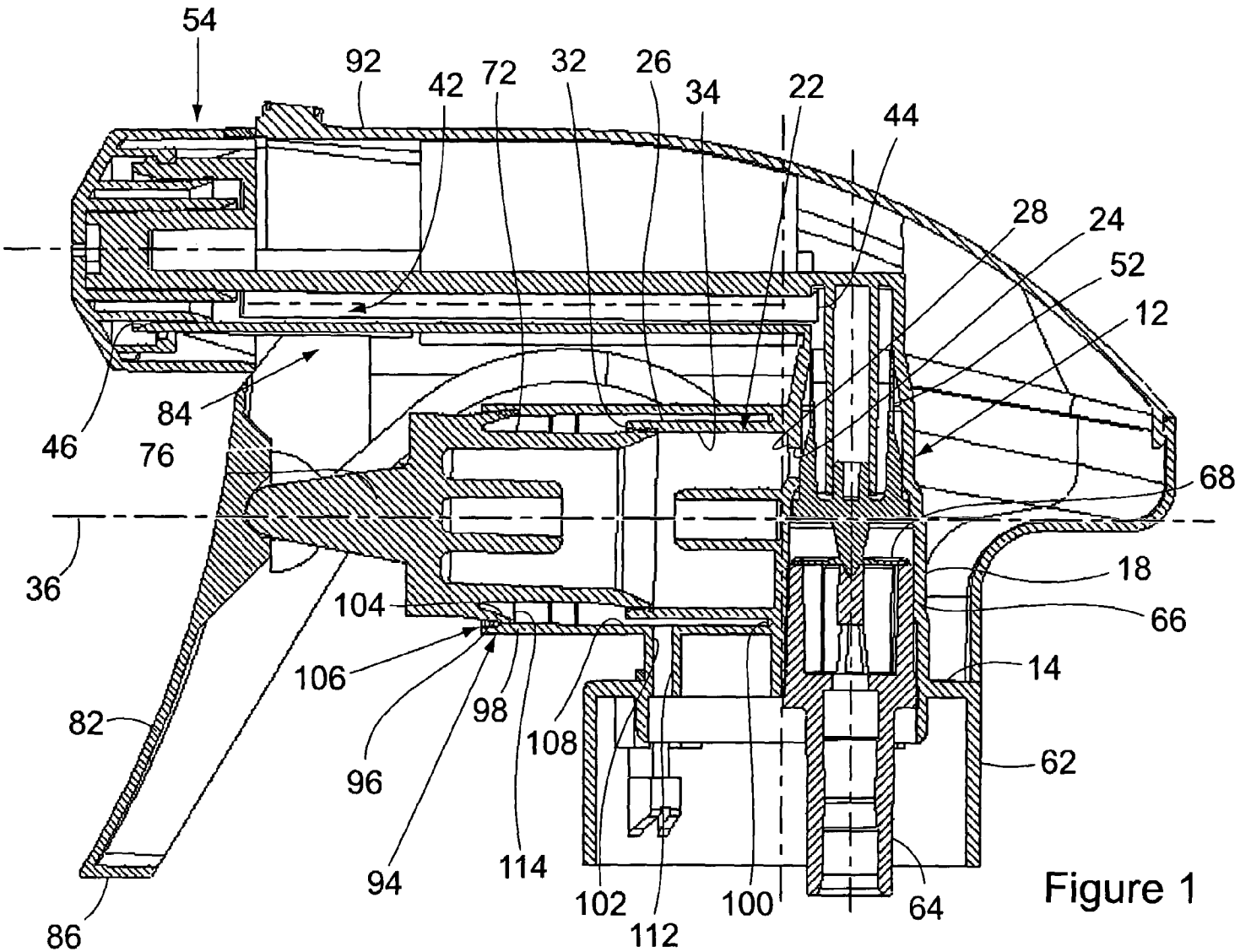
FIG. 1 is a side elevation view, in section, of the trigger sprayer apparatus of the invention in the first, vent closed position of the vent piston relative to the vent chamber.

FIG. 1 shows a side sectioned view of the trigger sprayer of the invention that includes the novel venting system of the invention. Many of the component parts and the details of construction of the trigger sprayer shown in FIG. 1 are common to trigger sprayers of the prior art. Therefore, these will only be described generally. The novel venting system of the invention will be described in more detail. As is typical in the construction of trigger sprayers, most of the component parts are constructed of a plastic material.

The trigger sprayer comprises a sprayer housing 12 that is molded with many of the component parts of the trigger sprayer. The bottom of the sprayer housing 12 is formed with a circular disk 14. An opening passes through the disk 14 and a liquid supply passage 18 extends upwardly through the sprayer housing from the disk. A pump chamber 22 is formed on the sprayer housing 12 and communicates through a pump port 24 with the liquid supply passage 18.

The pump chamber 22 is defined by a cylindrical side wall 26 of the chamber. The chamber also has a circular end wall 28. The pump port 24 passes through the end wall 28. The pump chamber side wall 26 extends from the end wall 28 to a distal end 32 of the side wall. The side wall distal end 32 surrounds a circular opening into the interior of the pump chamber. The side wall 26 has a cylindrical interior surface 34 that defines a center axis 36 of the pump chamber 22.

A liquid discharge passage 42 is also formed in the sprayer housing 12. The liquid discharge passage 42 has a length with a proximal end 44 that communicates with the liquid supply passage 18, and an opposite distal end 46.

A check valve 52 is mounted in the sprayer housing 12 adjacent the proximal end 44 of the liquid discharge passage 42. The check valve 52 permits liquid flow from the pump chamber 22 to the passage proximal end 44 and to the passage distal end 46, and prevents the reverse flow.

As is conventional, a nozzle assembly 54 is mounted to the distal end 46 of the liquid discharge passage 42.

Although particular constructions of the check valve 52 and nozzle assembly 54 are shown in the drawing figures, other equivalent types of valves and nozzle assemblies may be employed with the trigger sprayer of the invention.

A connector cap 62 is formed integrally with the circular disk 14 of the sprayer housing 12. The cap 62 is used in removably attaching the sprayer housing 12 to a separate liquid container. The cap 62 shown has a bayonet fitment for attachment to the liquid container. However, other equivalent types of connectors may be employed with the trigger sprayer of the invention.

A dip tube connector 64 extends upwardly through the cap 62 and through the opening in the bottom disk 14 of the sprayer housing 12. The dip tube connector 64 forms a portion of the liquid supply passage 18 that leads to the interior of the pump chamber 22. A valve seat assembly 66 is provided on the upper end of the dip tube connection 64 as viewed in FIG. 1. A disk valve 68 is positioned on the seat assembly 66. The disk valve 68 controls the flow of liquid through the liquid supply passage 18 to the pump chamber 22. The valve permits the flow of liquid through the supply passage 18 to the interior of the pump chamber 22, and prevents the reverse flow of liquid.

A cylindrical pump piston 72 is mounted in the interior of the pump chamber 22 for reciprocating movements in the pump chamber. The pump piston 72 is moveable in the pump chamber 22 between a first position of the piston shown in FIGS. 1 and 2, and a second position of the piston shown in FIG. 3. A coil spring (not shown) engages between the piston 72 and the end wall 28 of the pump chamber, as is conventional. The spring biases the pump piston 72 to its first position. The pump piston 72 is formed integrally with a piston rod 76 that extends outwardly from the pump piston and engages with a trigger 82 of the trigger sprayer.

The trigger 82 has a length with opposite proximal 84 and distal 86 ends. The trigger proximal end 84 mounts the trigger 82 to the sprayer housing 12 for movement of the trigger relative to the sprayer housing. Preferably, the trigger 82 pivots relative to the sprayer housing 12. The operative connection of the trigger 82 to the piston rod 76 and the pump piston 72 causes the reciprocating movement of the pump piston in the pump chamber 22 in response to movements of the trigger.

A shroud 92 covers over much of the exterior of the sprayer housing 12. The shroud 92 gives an aesthetically pleasing appearance to the trigger sprayer.

Much of the construction of the trigger sprayer described to this point is conventional. The novel venting system of the trigger sprayer is provided by a vent chamber 94 and a vent piston 96.

The vent chamber 94 is comprised of a cylindrical side wall 98 and a annular end wall 100. The end wall 100 is coplanar with and an extension of the pump chamber end wall 28. The vent chamber side wall 98 extends around and is coaxial with the pump chamber side wall 26. A vent opening 102 passes through the vent chamber side wall 98 and communicates an interior volume of the vent chamber 94 with the interior of the liquid container (not shown) attached to the trigger sprayer cap 62. The vent chamber side wall 98 has a cylindrical interior surface that defines a center axis of the vent chamber. The vent chamber center axis is coaxial with the pump chamber center axis 36. The vent chamber interior surface has a first surface section 104 that is adjacent a forward end opening 106 to the vent chamber, and a second interior surface section 108 that is adjacent the pump chamber 22. As seen in the drawing figures, the vent chamber first interior surface section 104 has a smaller interior diameter dimension than the vent chamber second interior surface section 108. The axial length of the vent chamber first interior surface section 104 is shorter than the axial length of the vent chamber second interior surface section 108. There is a gradual transition between the smaller diameter of the vent chamber first interior surface section 104 to the larger interior diameter of the second interior surface section 108. The second interior surface section 108 has a substantially constant interior surface diameter dimension between the first interior surface section 104 and the vent chamber annular end wall 100. A vent passage 112 extends through the vent chamber side wall 96 in the second interior surface section 108 of the vent chamber.

Figure 2:
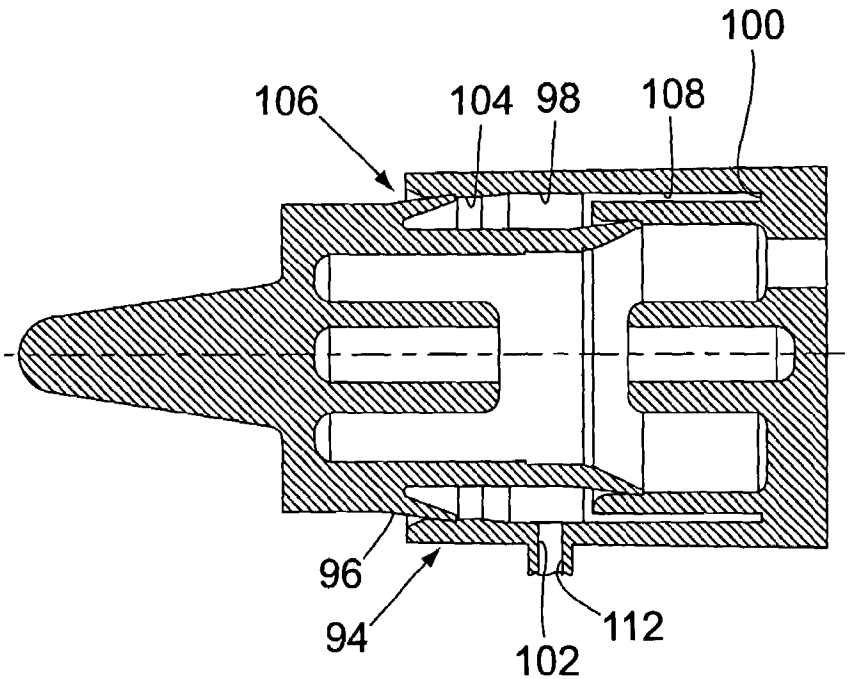
FIG. 2 is an enlarged, partial view of the pump chamber and vent chamber of FIG. 1 in the vent closed position of the vent piston; and, FIG. 3 is a view similar to FIG. 3, showing the vent piston in the vent opened position.

The vent piston 96 is an integral part of the pump piston 72 and the piston rod 76. The vent piston 96 is cylindrical and extends around the pump piston 72. Thus, the vent piston 96 and pump piston 72 have the same center axis. As seen in FIGS. 1 and 2, the pump piston 72 is spaced axially and radially inwardly from the vent piston 96. The vent piston 96 extends radially outwardly from the piston rod 76 to a resilient peripheral end portion 114 of the vent piston. This peripheral end portion 114 of the vent piston engages in a sliding, sealing engagement with the interior surfaces 104, 108 of the vent chamber 94. As seen in FIG. 1, the vent piston end portion 114 tapers slightly radially away from the remainder of the vent piston 94 as it extends to the distal end of the vent piston. This provides for a resilient sealing engagement of the vent piston peripheral end portion 114 with both the first interior surface section 104 and the second interior surface section 108 of the vent chamber interior surface.

Because the vent chamber first interior surface section 104 has a smaller interior diameter dimension than the vent chamber second interior surface section 108, the vent piston peripheral edge portion 114 exerts a greater force against the vent chamber first interior surface section 104 than the vent chamber second interior surface section 108. This assures a sealing engagement between the vent piston peripheral end portion 114 and the vent chamber first interior surface section 104 when the trigger sprayer is not in use. Thus, this ensures against the unintended leakage from the trigger sprayer attached to a liquid container if the sprayer and container should be positioned in an orientation that would cause liquid to exit the top of the container and pass through the vent opening 102 into the vent chamber 94.

When the trigger sprayer is operated, the vent piston peripheral end portion 114 moves from engagement with the vent chamber first interior surface section 104 to engage with the vent chamber second interior surface section 108. Although the engagement of the vent piston peripheral edge portion 114 in both the vent chamber first interior surface section 104 and second interior surface section 108 provides a sealing engagement that prevents the leakage of liquid through the vent chamber open end 106, the engagement force of the vent piston peripheral end portion 114 in the vent chamber second interior surface section 108 is less than that in the vent chamber first interior surface section 104. This reduces the drag or friction force exerted on the vent piston peripheral end portion 114 in the vent chamber second interior surface section 108. This reduced drag or friction force on the vent piston peripheral end portion eliminates the concern of swelling of the vent piston peripheral end portion 114 or swelling of the vent chamber sidewall 98, which could increase the force of engagement of the vent piston against the interior surface of the vent chamber and result in binding of the vent piston in the vent chamber.

Figure 3:
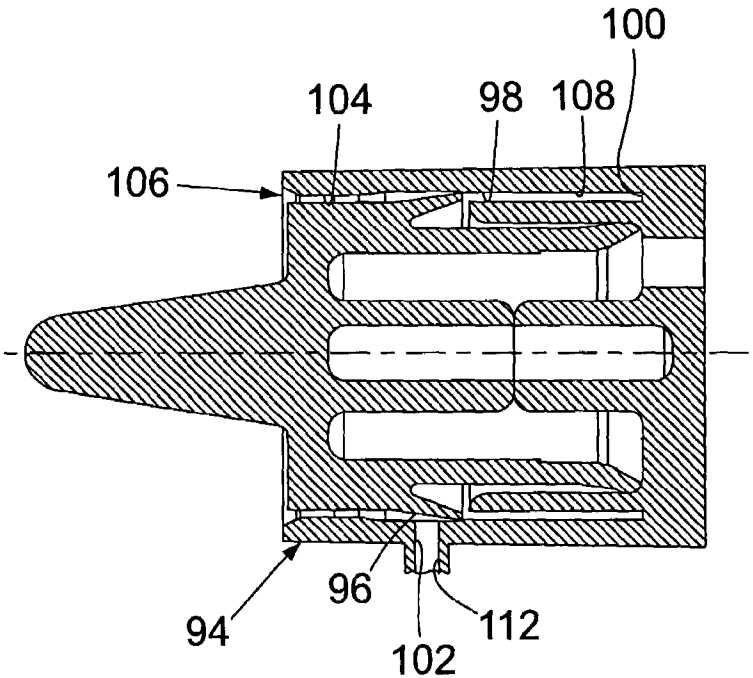

On operation of the trigger sprayer, as the trigger 82 is squeezed to the second position shown in FIG. 3, the vent piston 96 moves to its second position relative to the vent chamber 94. In the second position of the vent piston 96, the piston is moved through the vent chamber second interior surface section 108. The drag or friction force exerted on the vent piston peripheral edge 114 is reduced due to the increased diameter dimension of the vent chamber second interior surface section 108. The vent piston moves until the peripheral surface portion 114 passes over the vent chamber opening 102 that communicates through a vent passage 112 with the container interior. In the second position of the vent piston 94 shown in FIG. 3, the peripheral surface portion 114 of the vent piston has moved across the vent opening 102. This provides a flow path of venting air from the exterior environment of the trigger sprayer through the vent chamber 94 between the vent piston 96 and the vent chamber side wall 98, and through the vent chamber opening 102 to the interior of the liquid container connected to the trigger sprayer. In this manner, on operation of the liquid pump of the trigger sprayer, the interior of the liquid container connected to the trigger sprayer is vented.

On release of the trigger 82, the coil spring (not shown) returns both the pump piston 72 and vent piston 96 to their positions shown in FIGS. 1 and 2. In the position of the vent piston 96 shown in FIGS. 1 and 2, the peripheral surface portion 114 of the vent piston again engages in sealing engagement with the first interior surface section 104 of the vent chamber side wall 98, thus sealing the interior of the vent chamber 94 from the exterior environment of the sprayer.

With the novel construction of the venting system of the invention described above, the trigger sprayer of the invention overcomes disadvantages commonly associated with prior art trigger sprayer venting systems.

Although the trigger sprayer of the invention has been described above with reference to a specific embodiment of the sprayer, it should be understood that other variations of the sprayer may be arrived at without departing from the invention's scope of protection provided by the following claims.

The invention claimed is:

1. A manually operated, liquid dispensing trigger sprayer comprising:

a sprayer housing;

a liquid pump on the sprayer housing, the liquid pump including a pump chamber and a liquid piston mounted in the pump chamber for reciprocating movements of the liquid piston between first and second positions of the liquid piston in the pump chamber on operation of the liquid pump;

a liquid discharge passage extending through the sprayer housing and communicating with the liquid pump for directing liquid from the liquid pump, through the sprayer housing, and discharging the liquid from the sprayer housing on operation of the liquid pump;

a trigger mounted on the sprayer housing for movement of the trigger relative to the sprayer housing, the trigger being operatively connected to the liquid pump for operation of the liquid pump in response to movement of the trigger;

a vent chamber on the sprayer housing, the vent chamber having a cylindrical interior surface, the vent chamber interior surface having opposite first and second end sections with respective first and second interior diameter dimensions, the first interior diameter dimension being smaller than the second interior diameter dimension; and, a vent piston in the vent chamber and operatively connected to the liquid piston for movement of the vent piston between the first and second end sections of the vent chamber in response to the liquid piston moving between the respective first and second positions of the liquid piston in the pump chamber, the vent piston engaging with the vent chamber interior surface in both the first and second end sections of the vent chamber.

2. The trigger sprayer of claim 1, further comprising:

the pump chamber having a cylindrical sidewall; and, the vent chamber having a cylindrical sidewall that extends around the pump chamber sidewall with the pump chamber sidewall contained inside the vent chamber sidewall.

3. The trigger sprayer of claim 2, further comprising:

a vent opening through the vent chamber sidewall; and, the pump chamber sidewall overlapping the vent opening.

4. The trigger sprayer of claim 1, further comprising:

the pump chamber being positioned inside the vent chamber interior surface.

5. The trigger sprayer of claim 1, further comprising:

the vent chamber interior surface extending around the pump chamber.

6. The trigger sprayer of claim 1, further comprising:

the pump piston being positioned inside the vent piston.

7. The trigger sprayer of claim 1, further comprising:

the vent piston extending around the pump piston.

8. The trigger sprayer of claim 1, further comprising:

a vent opening through the vent chamber interior surface; and, the vent piston being movable in the vent chamber between first and second axially spaced positions of the vent piston in the vent chamber, the vent piston engaging against the vent chamber interior surface in the first position of the vent piston and the vent piston moving over the vent opening and engaging with the vent chamber interior surface when the vent piston is moved to the second position of the vent piston.

9. A manually operated liquid dispensing trigger sprayer comprising:

a sprayer housing;

a liquid pump chamber having a pump chamber sidewall on the sprayer housing;

a vent chamber having a cylindrical vent chamber sidewall on the sprayer housing, the vent chamber sidewall having a first section with a first interior diameter dimension and a second section with a second interior diameter dimension, the second interior diameter dimension being larger than the first interior diameter dimension, and a vent opening through the second section of the vent chamber sidewall;

a liquid discharge passage extending through the sprayer housing and communicating with the pump chamber for directing liquid from the pump chamber, through the sprayer housing, and discharging the liquid from the sprayer housing;

a pump piston mounted in the pump chamber for reciprocating movement of the pump piston in the pump chamber;

a vent piston mounted in the vent chamber for reciprocating movement of the vent piston in the vent chamber, the vent piston engaging around the vent chamber sidewall in the first and second sections of the vent chamber sidewall and the vent piston moving over the vent opening as the vent piston is moved from the first section to the second section of the vent chamber sidewall; and, a trigger mounted on the sprayer housing for movement of the trigger relative to the sprayer housing, the trigger being operatively connected to the pump piston and the vent piston for reciprocating movement of the pump piston and vent piston in the respective pump chamber and vent chamber in response to movement of the trigger.

10. The trigger sprayer of claim 9, further comprising:

the pump chamber sidewall having a cylindrical interior surface with a center axis;

the vent chamber sidewall having a center axis; and, the pump chamber center axis being coaxial with the vent chamber center axis.

11. The trigger sprayer of claim 9, further comprising:

the pump piston being positioned inside the vent piston.

12. The trigger sprayer of claim 9, further comprising:

the vent piston having an axial length and the pump piston having an axial length, with the pump piston axial length being larger than the vent piston axial length.

13. The trigger sprayer of claim 9, further comprising:

the vent chamber sidewall extends around the pump chamber sidewall with the pump chamber sidewall contained inside the vent chamber sidewall.

14. The trigger sprayer of claim 13, further comprising:

the pump chamber sidewall overlapping the vent opening.

15. A manually operated liquid dispensing trigger sprayer comprising:

a sprayer housing;

a liquid pump chamber on the sprayer housing;

a vent chamber on the sprayer housing, the vent chamber having a cylindrical sidewall;

a liquid discharge passage communicating with the liquid pump chamber and extending through the sprayer housing for directing liquid from the pump chamber, through the sprayer housing, and discharging the liquid from the sprayer housing;

a pump piston mounted in the pump chamber for reciprocating movement of the pump piston in the pump chamber, the pump piston being cylindrical and having a center axis;

a vent piston mounted in the vent chamber for reciprocating movement of the vent piston between a first position and a second position of the vent piston in the vent chamber, the vent piston being cylindrical and having a center axis that is coaxial with the pump piston center axis, the vent piston engaging with an engagement force against the vent chamber sidewall in both the first position and second position of the vent piston in the vent chamber, and the engagement force with the vent piston in the first position is larger than the engagement force with the vent piston in the second position; and, a trigger mounted on the sprayer housing for movement of the trigger relative to the sprayer housing, the trigger being operatively connected to the pump piston and the vent piston for reciprocating movement of the pump piston and vent piston in the respective pump chamber and vent chamber in response to movement of the trigger.

16. The trigger sprayer of claim 15, further comprising:

the vent chamber sidewall having a first section with a first interior diameter dimension and a second section with a second interior diameter dimension, the second interior diameter dimension being larger than the first interior diameter dimension.

17. The trigger sprayer of claim 16, further comprising:

the pump chamber having a cylindrical sidewall that is contained inside and spaced inwardly from the vent chamber sidewall.

18. The trigger sprayer of claim 15, further comprising:

a vent opening in the vent chamber sidewall, the pump chamber extending over the vent opening.

19. The trigger sprayer of claim 15, further comprising:

the pump chamber having a cylindrical sidewall; and, a vent opening in the vent chamber sidewall, the pump chamber sidewall overlapping the vent opening.

* * * * *